US007375692B2

(12) United States Patent
Mondadori et al.

(10) Patent No.: US 7,375,692 B2
(45) Date of Patent: May 20, 2008

(54) SERIGRAPHED ANTENNA FOR A MOTOR VEHICLE

(75) Inventors: Alessandro Mondadori, Poissy (FR); Didier Viratelle, Voisins-le-Bretonneux (FR)

(73) Assignee: Societe de Composants Electriques (FR)

( * ) Notice: Subject to any disclaimer, the term of this patent is extended or adjusted under 35 U.S.C. 154(b) by 27 days.

(21) Appl. No.: 10/588,244

(22) PCT Filed: Feb. 7, 2005

(86) PCT No.: PCT/FR2005/000269

§ 371 (c)(1),
(2), (4) Date: Aug. 2, 2006

(87) PCT Pub. No.: WO2005/078858

PCT Pub. Date: Aug. 25, 2005

(65) Prior Publication Data

US 2007/0109207 A1 May 17, 2007

(30) Foreign Application Priority Data

Feb. 6, 2004 (FR) ..... 04 01141

(51) Int. Cl.
*H01Q 1/32* (2006.01)

(52) U.S. Cl. ..... 343/713; 343/711

(58) Field of Classification Search ..... 343/713, 343/711, 704
See application file for complete search history.

(56) References Cited

U.S. PATENT DOCUMENTS

| | | | |
|---|---|---|---|
| 5,510,805 | A | 4/1996 | Lee |
| 5,883,599 | A | 3/1999 | Hall |
| 6,236,372 | B1 | 5/2001 | Lindenmeier et al. |

FOREIGN PATENT DOCUMENTS

| | | |
|---|---|---|
| EP | 0 854 533 A1 | 7/1998 |
| GB | 1 202 522 | 8/1970 |
| WO | WO 93/18634 | 9/1993 |

*Primary Examiner*—Hoang V Nguyen
(74) *Attorney, Agent, or Firm*—Gerald E. Hespos; Anthony J. Casella

(57) ABSTRACT

The antenna FM2 comprises a serigraphed aerial on the rear opening window (2) of a station wagon and consists of a defrosting network (4) with two superposed symmetrical vertical lines (5). A thick ground line (8) is serigraphed onto the rear window (2) and a two-wire cable (11, 12) joins the aerial FM2 to an electronic housing (9). On a quarter panel window of the vehicle, the aerial is serigraphed in the form of an F-shape of the servitude antenna and joined by a two-wire cable (19, 20) to an electronic housing (9). The serigraphed antenna for a rear window and for a quarter panel window of a station wagon provides excellent reception in both FM and servitude mode.

10 Claims, 2 Drawing Sheets

SERIGRAPHED ANTENNA FOR A MOTOR VEHICLE

This application is a 371 of PCT/FR05/00269 dated Feb. 7, 2005.

The present invention relates to the antennas fitted to motor vehicles, more particularly the antennas serigraphed on the rear window of such vehicles, and especially motor vehicles of the station wagon type.

The antennas intended to be mounted on board private or utility vehicles are more and more commonly being incorporated in such a way that they are no longer visible from outside the vehicle, thus permitting this vehicle to have a more unified appearance which appeals to current taste among the public. The drawbacks linked to the use of protruding equipment, which include considerations of aerodynamics, noise, vibrations, sealing-tightness and vandalism are thus greatly reduced.

This being the case, it is important that the antenna be placed in an environment such that it is able to continue to carry out its essential function which consists of a transduction of an electromagnetic field (external to the vehicle) into an electrical signal which can be used by radio equipment.

A compromise therefore always has to be sought between the position of the antenna which it is desired to conceal as much as possible and its radiating performance which is affected to a greater extent the more the radiating structure of the antenna is incorporated into the vehicle and in particular the closer it is to its metal parts.

On the other hand, automobile manufacturers attach great importance to a single so-called "multi-function" housing including a number of functions, which makes it possible to simplify incorporation into the vehicle and the passage of the cables connecting this housing to the car radio reception device or to the device which requires the signals received by the antenna.

FM and remote keyless entry antennas have linear terrestrial polarisation and the reference is an antenna of a length equal to one quarter the wavelength (or a length of about 750 mm for FM and 170 mm for remote keyless entry).

The current state of the art offers numerous possibilities for so-called concealed antennas, in particular for the following three reception-radio functions:

- FM radio (Frequency Modulation between 76 MHz and 108 MHz);
- AM radio (Amplitude Modulation) between 140 kHz and 1.7 MHz;
- Remote keyless entry function 434 MHz (or 315 MHz for Japan).

The radiating part of these antennas is formed by conductive lines serigraphed onto the glazed part of the vehicle which then serves as a support. The lines are of a thickness of 0.8 mm permitting passage of a current sufficient and acceptable for good operation of the defroster.

As a supplement to this radiating part on the rear window, antennas serigraphed on the left and/or right rear quarter panel windows can be added either for the FM radio application or for the AM radio application.

For a station wagon type vehicle the opening rear window is used as a support for the aerial of the FM antenna and the quarter panel window contains an aerial used for both remote keyless entry and AM, and possibly FM, functions. The two glazed supports (rear window and quarter panel) must be produced in a typical manner without application of an a thermal process.

In general, each of the functions of concealed FM, AM and remote keyless entry antennas use an aerial and an electronic circuit which is as close as possible thereto.

- The aerial of the AM antenna is formed from one or a plurality of conductive lines of a thickness of about 0.8 mm in the central part of the quarter panel window. The electronic housing comprises an electronic circuit effecting a high impedance adaptation from the aerial towards the radio receiver.
- The aerial of the FM antenna on the rear window is formed from a number of conductive horizontal lines varying between a minimum of 10 and a maximum of 30. These lines, being of a thickness of about 0.8 mm, are also involved in the defrosting function. The electronic housing comprises a circuit effecting the adaptation of the aerial impedance to the characteristic impedance of the coaxial cable exiting the housing, i.e equal to a value which is as close as possible to 75 ohms.
- The aerial of the FM antenna on the quarter panel window is formed by a number of conductive lines in the central part of the quarter panel window. The electronic housing comprises a circuit effecting the adaptation of the aerial impedance to the characteristic impedance of the coaxial cable exiting the housing, i.e. equal to a value as close as possible to 75 ohms.
- The aerial of the remote keyless entry antenna can be identical to the AM Trial or FM aerial. The electronic housing comprises an electronic circuit board effecting the adaptation of the aerial impedance to the impedance of the coaxial cable exiting the housing, i.e. close to 50 ohms.

This housing is said to be passive or active according to whether a power supply of +12V coming directly or indirectly from the battery of the vehicle is used. The function of the active housing is to amplify the signal with the use of one or a plurality of transistors. The choice of using an active or passive electronic housing is made according to the average gain of the antenna calculated with respect to a reference antenna (quarter-wave antenna) on a squared mass basis of 1.5 m per side and 1.5 m in height with respect to the ground.

In general, the minimum acceptable gain with respect to the reference antenna is about −10 dB. The average gain is obtained by calculating the average of 360 measurement values (a measurement for each degree around the vehicle). If, with a passive housing, the antenna is below this limit of −10 dB an active housing will generally be used to compensate for the missing dB.

In top-of-the-range vehicles the FM reception is improved by bringing together different antennas, from two to possibly as many as four, called FM1, FM2, FM3 and FM4. These different antennas can use as a support both the rear window or the right and/or left quarter panel windows. The signal on each aerial is picked up at a point called the collector point using a simple wire. The connection between the aerial and the wire is made by a push button. The other end of the wire is connected to a housing at a distance not greater than 150 mm.

The various FM1, FM2, FM3 and FM4 antennas can use the same aerial but with the collector point disposed differently thereon. Thus the electromagnetic responses of these antennas, which are the radiation patterns, are different. In fact, these collector points create different surface currents on these aerials. These different antennas can thus be combined signals added or subtracted or switched in rotation) in order to provide an output signal which is improved with respect to a single serigraphed antenna.

This antenna system is intended for vehicles having a rear window which is of a standard design, of the type extruded without application of an athermal process.

The object of the present invention is to propose a serigraphed antenna device for the rear window and the quarter panel window of a motor vehicle of the station wagon type of the general known kind mentioned above, which, while ensuring excellent reception of the signals both in frequency modulation and in the remote keyless entry function, is of a design and implementation which are particularly simple and economical.

The antenna serigraphed on the opening rear window and quarter panel window of a station wagon type motor vehicle in accordance with the invention has at least the functions of FM2 radio and remote keyless entry reception, each of these antenna functions comprising an aerial and an electronic circuit which is as close as possible thereto, the aerial of the FM2 antenna on the rear window incorporating the defrosting network, and the aerial of the remote keyless entry antenna being supported by the quarter panel window, and is characterised in that the aerial of the FM2 antenna comprises two vertical lines which are symmetrical with respect to a middle longitudinal vertical plane and are superimposed with the defrosting network.

Advantageously the serigraphy of the defrosting network incorporated into the aerial of the FM2 antenna according to the invention has a U shape and the said aerial comprises a serigraphed earth line of a length of the order of 530 mm.

According to a supplementary feature the antenna according to the invention comprises a two-wire cable to pick up the FM signal at the aerial of the FM2 antenna and to transmit it to an electronic housing, this two-wire cable comprising an earth wire connected to the serigraphed earth and an FM signal wire connected to the symmetrical lines of the serigraphed aerial. The points of connection of the earth wire and the FM signal wire are disposed very close to each other to permit use at the end of the two-wire cable of a connector with two push buttons.

According to another feature of the invention the aerial of the remote keyless entry antenna is of an F shape serigraphed on the quarter panel window of the vehicle, which resonates at 434 MHz with an impedance of 50 ohms at its power supply point. The aerial also has a serigraphed earth line, of a length of the order of 150 mm, and a two-wire cable is used to pick up the remote keyless entry signal at the aerial of the antenna and to transmit it to the electronic housing.

In order to ensure good understanding of the invention a preferred embodiment will be described hereinunder by way of non-limiting example with reference to the attached schematic drawing in which.

Figure 1:
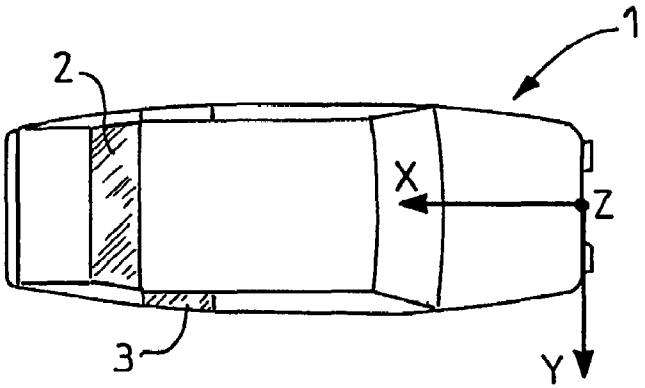
FIG. 1 is a very schematic plan view of a station wagon type vehicle with its Cartesian reference axes shown.

With reference to FIG. 1, at the point 1 a motor vehicle of the station wagon type is schematically illustrated, comprising in particular an opening rear window 2 and a right quarter panel window 3.

In accordance with the invention the opening rear window 2 of the vehicle 1 serves as a support for a serigraphed FM2 antenna and the right quarter panel window 3 supports the aerial of a remote keyless entry antenna to provide an FM2 signal for the FM band and a remote keyless entry signal.

Figure 2:
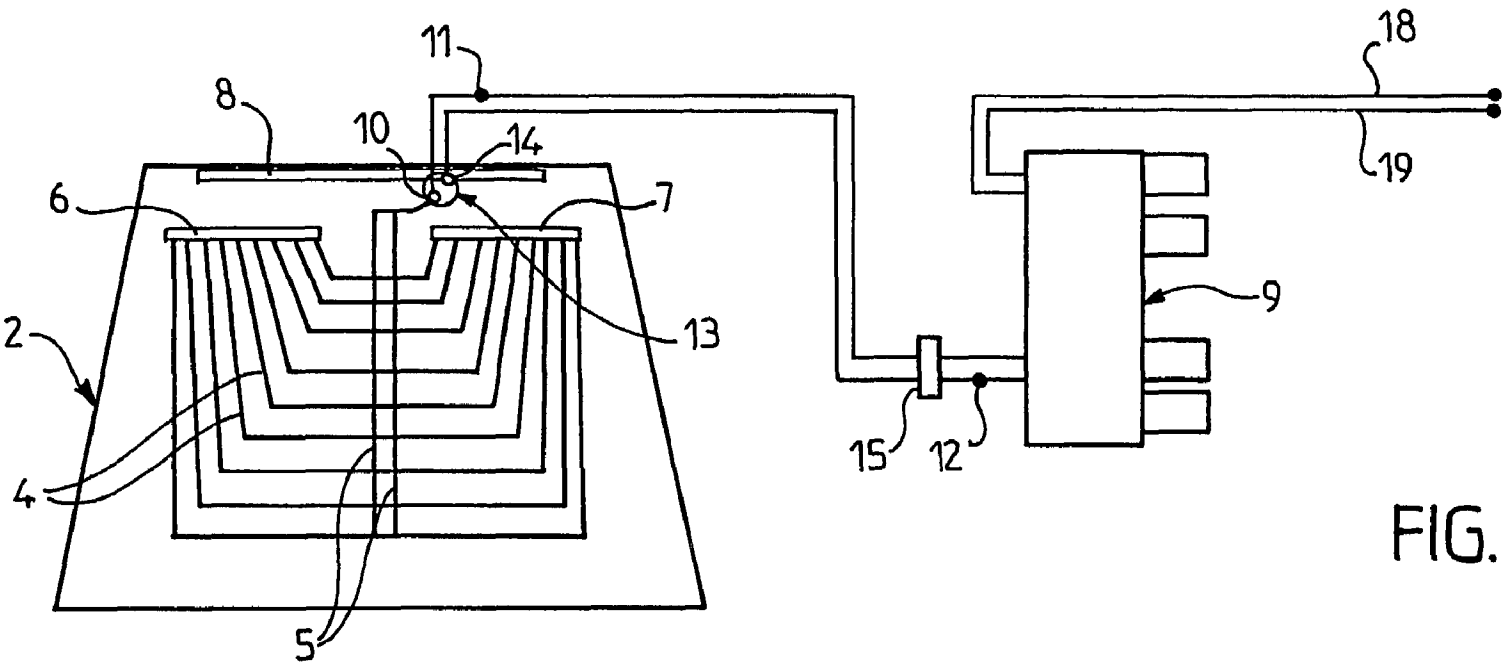
FIG. 2 is a plan view of the opening rear window of a station wagon type motor vehicle serving as a support for the aerial of an FM2 antenna.

With reference to FIG. 2 the FM2 antenna is formed by an FM2 aerial and an active electronic housing. The aerial of the FM2 antenna which is serigraphed on the opening rear window 2 is formed by the original defrosting network 4 having a U shape on which are superimposed two vertical lines 5 which are symmetrical with respect to the middle longitudinal vertical plane of the vehicle 1. The defrosting network 4 comprises defrosting collectors 6, 7 which are supplied with power in their middle.

A thick serigraphed line 8 of about 530 mm in length is coupled by proximity to a large earth plane such as the chassis of the vehicle 1, the internal metal flap of the tailgate or the adhesive fixing the rear window to the metal tailgate. Only this serigraphed line 8 can be located in the proximity (or at a distance less than 10 mm) of a metal part. In contrast, the serigraphy 4, 5, 6, 7 which forms part of the FM2 aerial must not be too close to the metal structure of the vehicle 1 because there would be coupling to the metal which would cause a resulting loss of the FM2 signal. In order to avoid this, the serigraphy 4, 5, 6, 7 must be at least 7 mm away from the metal edge and there must be no superimposition with metal parts of the vehicle 1.

For good operation of the system, a filtering and decoupling device is used on the power supply wires of the defroster, connecting the collectors 6, 7 of the defrosting network 4 to the positive pole of the battery and to the earth. This filtering and decoupling device, not shown in the drawing, is composed of an inductor disposed on the power supply wire connected to the positive pole of the battery and of an inductor placed on the earth wire, the two inductors being disposed about 100 mm from the defroster collector 6, 7. These inductors avoid the radio frequency signal being conducted by the power supply wires of the defroster to the positive terminal or to the negative terminal of the battery.

The dimensions of the antenna serigraphy depend on the surface of the rear window 2. The FM2 antenna system on the opening rear window 2 shown in FIG. 2 is adapted to a rectangular opening rear window with an approximate surface which is not less than 0.48 $m^2$.

The electronic housing 9 adapts the impedance of the FM2 antenna to 75 ohms. The FM2 signal is picked up at a connection point 10 on the part of the aerial formed by the two vertical lines 5, the position of which is chosen to permit an FM2 antenna to be obtained which is directional in the direction of the X axis, on the plane Z=0 (see FIG. 1).

Figure 5:
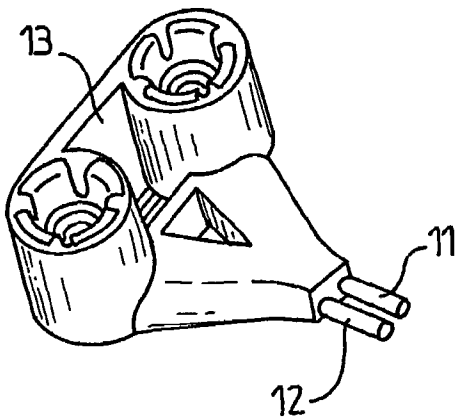
FIG. 5 is a perspective view of the lower face of a connector with a double push button serving to connect the two-wire cable to the aerial of the FM2 antenna.

The picking up of the FM2 signal at the connection point 10 is effected by a two-wire cable formed from wires 11, 12, having at one end a connector 13 (FIG. 5) of the type with a double push button engaging the connection point 10 of the serigraphed network and a connection point 14 of the earth line 8 disposed in the immediate proximity of the connection point 10. The wires 11, 12 have a length of one meter between the rear window 2 and the electronic housing 9.

The two-wire cable 11, 12 can be interrupted by means of a conventional connector 15 to permit fixing of this two-wire cable 11, 12 to the chassis. A length of one meter is selected because this constitutes passage of a half wavelength at 98 MHz in a vehicle type environment. According to the placement of the two-wire cable 11, 12 and this cable's environment in the vehicle 1, to the distance between the two-wire cable 11, 12 and the chassis, and to the possible presence of other foreign bodies in the proximity of the two-wire cable 11, 12, the value of the impedance which is dependent on the frequency can thus differ from one vehicle to another.

The FM2 electronic circuit associated with the electronic housing 9 can also change for each vehicle. However, the choice of a length for the two-wire cable 11, 12 equal to a half wavelength correctly responds to the cable's environment in the vehicle.

The impedance of the FM2 aerial at the collector is also found at the entrance of the electronic housing apart from the detail of the cross coupling between the two-wire cable and the chassis. Using a length of one meter of the two-wire cable 11, 12 the system thus makes it possible to respond "transparently" to possible different installations of the two-wire cable 11, 12 in each vehicle produced.

In the illustrated example the two-wire cable 11, 12 used is composed of two flat conductive copper wires (or wires having a core resistance lower than 40 ohms per km), each wire consisting of a strand of a number of conductors (between three and ten) for a maximum overall diameter of 0.9 mm. The two conductive wires 11, 12 are isolated (operating voltage less than 45 V) with a material compliant with the demands of the manufacturer of the vehicle 1. The maximum dimensions do not exceed 1.60×3.30 mm including the sheath.

The two-wire cable 11, 12 terminates at the end of one meter by the double push button connector 13 which has pitch of 15 mm.

The location selected to install the electronic housing 9 is the right or left interior strut of the vehicle 1, towards the top at the passage sleeve between the chassis and the tailgate of the rear door. The housing 9 is rectangular and is disposed on the rear metal panel or on the metal strut. It is fixed by a screw to the chassis, this chassis then serving to obtain the earth signal.

Figure 3:
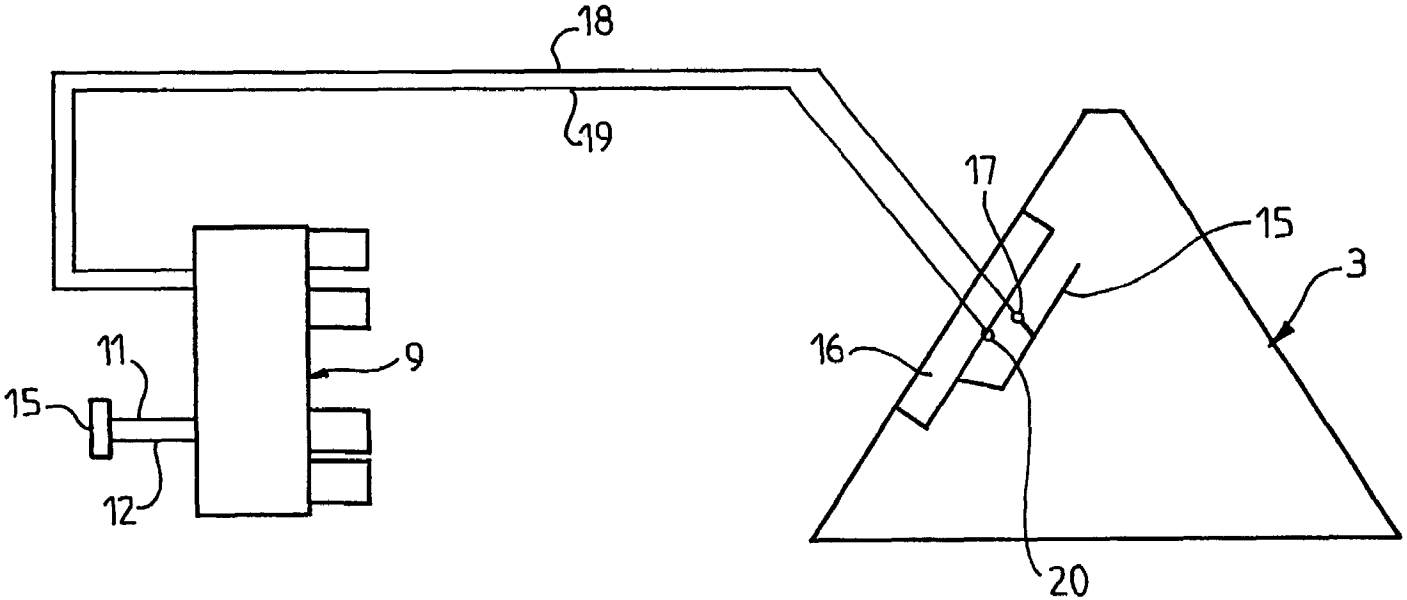
FIG. 3 is an elevational view of the aerial of the remote keyless entry antenna fitted to a quarter panel window of the station wagon type motor vehicle of FIG. 2.
Figure 4:
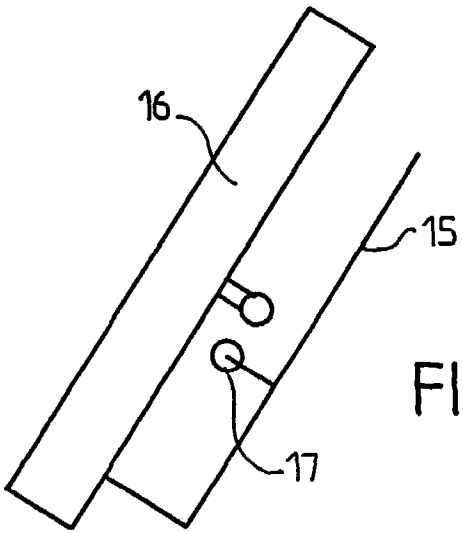
FIG. 4 is a detailed view, on an enlarged scale, of the aerial of the remote keyless entry antenna of FIG. 3.

The second antenna fulfilling the remote keyless entry function is shown in FIG. 3. It is composed of a remote keyless entry aerial and a passive adaptation electronic circuit placed in the electronic housing 9. The remote keyless entry aerial is formed by serigraphy 15 in the form of an F (shown on a larger scale in FIG. 4) produced on the right quarter panel window 3 on the same side of the electronic housing 9. A collector point 17 of the remote keyless entry signal is placed at the end of the horizontal lower arm of the serigraphed F 15.

A thick serigraphed line 16 (FIGS. 3 and 4) is in contact with the adhesive fixing the quarter panel window 3 to the chassis. The adhesive is disposed in a so-called primary region.

A two-wire cable 18, 19 of a length of 400 mm, connects the collector point 17 of the aerial which is located on the quarter panel window 3 and a passive adaptation circuit disposed in the electronic housing 9. The length of 400 mm for the two-wire cable 18, 19 is chosen because it constitutes passage of a wavelength at 434 Mz [sic] in a vehicle type environment.

According to the placement of the two-wire cable and the environment around this cable in the vehicle, to the distance between the two-wire cable and the chassis, to the possible presence of other foreign bodies in the proximity of the two-wire cable, the value of the impedance which is dependent on the frequency can thus differ from one vehicle to another. This causes a modification in the overall response of the impedance of the aerial from one car to another. Furthermore, the electronic circuit associated with the housing can also change for each vehicle. However, the choice of a length for the two-wire cable equal to a half wavelength correctly responds in the environment of the aerial. The impedance of the aerial at the collector point 17 is also found at the entrance of the electronic housing 9, apart from the detail of the cross coupling between the two-wire cable 18, 19 and the chassis. Using the length of 400 mm for the two-wire cable the system makes it possible to respond "transparently" to possible different installations of the two-wire cable 18, 19 in each vehicle produced.

The two-wire cable 18, 19 used has, apart from its length, the same features as those indicated above for the two-wire cable 11, 12 of the FM2 antenna and it is thus not necessary to repeat them here. This two-wire cable 18, 19 also terminates by a double push button connector (not shown in the drawing but which is identical to the connector 13 of FIG. 5) with a pitch of 15 mm. This connector cooperates with the collector point 17 of the serigraphed aerial 15 which is F-shaped and has a point 20 on the serigraphed earth line 16 which is chosen in the immediate proximity of the collector point 17.

The dimensions of the serigraphy of the remote keyless entry antenna are defined to cause the aerial to resonate around 434 MHz, a maximum radiated gain being obtained with an impedance at the power supply point of the aerial equal to 50 ohms. The dimensions suitable for this effect of the remote keyless entry aerial 15 being a length of the vertical bar of the F of 130 mm, a distance between the two horizontal bars of the F of 55 mm, a distance of 20 mm between the vertical bar of the F and the earth line 16, and an offset of 10 mm between the upper end of the F and the corresponding end of the earth line 16.

This remote keyless entry antenna system shown in FIG. 3 is adapted for a triangular or trapezoidal quarter panel shape having an approximate surface which is not less than 0.08 $m^2$.

It will be understood that the description above has been given simply by way of example, without being limitative, and that constructional modifications or additions could be made thereto without departing from the scope of the present invention.

The invention claimed is:

1. An antenna system for a station wagon type vehicle comprising an opening rear window (2) provided with a defrosting network (4) and a quarter panel window (3), the antenna system comprising:

a first antenna comprising an aerial produced by screen printing on the rear window (2) and incorporating the defrosting network (4), the said aerial comprising two vertical lines (5) extending symmetrically with respect to the middle longitudinal vertical plane of the vehicle and being superimposed with the defrosting network, a second antenna comprising an aerial (15) produced by screen printing on the quarter panel window (3), and an electronic circuit located in the proximity of each of the aerials of the first and second antennas, characterised in that the first antenna is an FM2 antenna intended to receive frequency modulated radio waves, in the band 76 MHz to 108 MHz, while the second antenna is a remote keyless entry antenna intended to receive waves having a frequency of 434 MHz or 315 MHz, and in that the aerial of the FM2 antenna has an earth line (8) having a length of the order of 530 mm and serving as an earth for the FM signal, the FM2 antenna comprises a two-wire cable (11, 12) to pick up the FM signal received by its aerial and to transmit this signal to an electronic housing (9), the two-wire cable (11, 12) comprising an earth wire (12) connected to the earth line (8) and an FM signal wire (11) connected to the symmetrical lines (5).

2. The antenna system as claimed in claim 1, characterised in that the defrosting network (4) has a U shape, the arms of which are directed upwards.

3. The antenna system as claimed in claim 1, characterised in that the point of connection (14) of the earth wire (12) to the earth line (8) and the point of connection (10) of the FM signal wire (11) to the aerial of the FM2 antenna are placed in the immediate proximity of each other.

4. The antenna system as claimed in claim 1, characterised in that the aerial (15) of the remote keyless entry antenna is in the shape of an F.

5. The antenna system as claimed in claim 4, characterised in that the aerial (15) of the remote keyless entry antenna resonates at 434 MHz with an impedance of 50 ohms at its power supply point.

6. An antenna system for a station wagon type vehicle comprising an opening rear window (2) provided with a defrosting network (4) and a quarter panel window (3), the antenna system comprising:

a first antenna comprising an aerial produced by screen printing on the rear window (2) and incorporating the defrosting network (4), the said aerial comprising two vertical lines (5) extending symmetrically with respect to the middle longitudinal vertical plane of the vehicle and being superimposed with the defrosting network, a second antenna comprising an aerial (15) produced by screen printing on the quarter panel window (3), and an electronic circuit located in the proximity of each of the aerials of the first and second antennas, characterised in that the first antenna is an FM2 antenna intended to receive frequency modulated radio waves, in the band 76 MHz to 108 MHz, while the second antenna is a remote keyless entry antenna intended to receive waves having a frequency of 434 MHz or 315 MHz, and in that the aerial of the FM2 antenna has an earth line (8) having a length of the order of 530 mm and serving as an earth for the FM signal, the aerial (15) of the remote keyless entry antenna having a screen printed earth line (16) of a length of the order of 150 mm and serving as an earth for the 434 MHz signal.

7. The antenna system as claimed in claim 6, characterised in that the remote keyless entry antenna comprises a two-wire cable (18, 19) to pick up the remote keyless entry signal received by its aerial (15) and to transmit this signal to the electronic housing (9), the two-wire cable (18, 19) comprising an earth wire (19) connected to the earth line (16) and a remote keyless entry signal wire (18) connected to the aerial (15) at the power supply point (17) thereof.

8. The antenna system as claimed in claim 7, characterised in that the point of connection (20) of the earth wire (19) to the earth line (16) and the power supply point (17) where the remote keyless entry signal wire (18) is connected to the aerial (15) are placed in the immediate proximity of each other.

9. The antenna system as claimed in claim 6, characterised in that the aerial (15) of the remote keyless entry antenna is in the shape of an F.

10. The antenna system as claimed in claim 9, characterised in that the aerial (15) of the remote keyless entry antenna resonates at 434 MHz with an impedance of 50 ohms at its power supply point.

* * * * *